United States Patent [19]

Wahl

[11] 4,354,367

[45] Oct. 19, 1982

[54] COMBINATION LOCK FOR ATTACHE CASES AND SIMILAR ARTICLES

[76] Inventor: Philippe Wahl, 89A, route de Florissant, 1206 Geneve, Switzerland

[21] Appl. No.: 35,281

[22] Filed: May 2, 1979

[30] Foreign Application Priority Data

May 2, 1978 [CH] Switzerland ..... 4728/78

[51] Int. Cl.[3] ..... E05B 15/16

[52] U.S. Cl. ..... 70/333 A; 70/DIG. 56; 70/455

[58] Field of Search ..... 70/2–5, 70/333 A, 442, 455, DIG. 43, DIG. 56

[56] References Cited

U.S. PATENT DOCUMENTS

| | | | |
|---|---|---|---|
| 546,969 | 9/1895 | Bozaro | 70/442 |
| 641,458 | 1/1900 | Logan | 70/442 |
| 712,830 | 11/1902 | Mills | 70/442 |
| 1,123,886 | 1/1915 | Kaszewski | 70/333 A |
| 1,357,720 | 11/1920 | Newman | 70/442 |
| 3,313,136 | 4/1967 | Gulette | 70/455 |
| 3,930,391 | 1/1976 | Borlinghaus | 70/455 |

*Primary Examiner*—Robert L. Wolfe

*Attorney, Agent, or Firm*—Robert E. Burns; Emmanuel J. Lobato; Bruce L. Adams

[57] ABSTRACT

A combination lock for attache cases and the like. The lock has a plurality of movable elements for setting a combination for selectively locking the lock. A mask is provided which is spring-biased to a first of two rest positions in which the mask conceals the digits. In the second rest position the mask exposes the digits to view. The mask is disposed to mask or block a clasp element of a lock clasp in one embodiment and in a second it masks a release button for opening the lock.

4 Claims, 11 Drawing Figures

COMBINATION LOCK FOR ATTACHE CASES AND SIMILAR ARTICLES

BACKGROUND OF THE INVENTION

The combination of combination locks used on attache cases and similar articles is generally a three- or four-digit number which must be formed, generally in a window, by correct positioning of movable elements, for instance wheels. This number, which generally is known only to the owner of the attache case, is visible upon the opening and upon the closing by combination of the lock and generally remains visible between these two operations, frequently for a relatively long period of time, for instance for the duration of a meeting, either because the owner or the attache case does not think of scrambling the combination after opening or in order, not by scrambling it, to clearly give evidence of a certain distrust of those with whom he is speaking or, merely very simply, in order to avoid having to reform the combination upon the closing of the lock.

However, it is obvious that under these circumstances combination locks practically lose their entire reason for existence since in this way the possibility is afforded meddlesome persons of at a propitious moment opening the attache case without breaking into it, and taking note of the frequently confidential documents which it may contain.

SUMMARY OF THE INVENTION

The object of the present invention is a combination lock for attache cases and similar articles which makes it possible to eliminate this drawback. For this purpose, this lock is characterized by the fact that it has a mask which can be moved between two positions, a first position in which the digits forming the number displayed are concealed and a second position in which these digits are visible.

In a preferred embodiment, the lock will have a return spring which automatically returns the mask into its first position.

BRIEF DESCRIPTION OF THE DRAWINGS

Several embodiments of the object of the invention are shown in the drawing by way of illustration and not of limitation.

DESCRIPTION OF THE PREFERRED EMBODIMENTS

Figure 1:
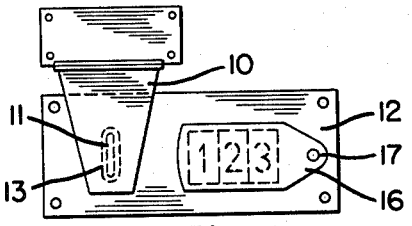
FIGS. 1 and 2 are two front views of the first embodiment, showing the mask in its two positions respectively.
Figure 2:
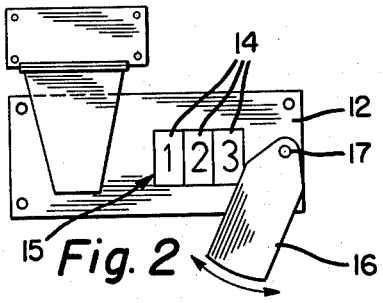

The combination lock shown in FIGS. 1 and 2 makes it possible to lock an attache case of which there is shown the pivoting clasp 10 which bears the catch 11 on the inside and the stationary plate 12 having an opening 13 into which the catch 11 must be engaged in order to receive the bolt, not shown in the drawing.

The means for the opening and closing of this lock comprise three wheels 14 on the circumference of which there are printed the digits 0 to 9. Each wheel can be rotated by hand through a window 15 cut out in the plate 12.

The digits displayed in the window 15 form a given number by the angular positions of the wheels 14. For all numbers which can be formed, with the exception of a single one, the bolt of the lock is in working position, that is to say the attache case is locked if the catch 11 is in its turn engaged in the opening 13.

On the other hand, when the number displayed in the window corresponds to a number which is known in principle only to the owner of the attache case, herein referred to as the combination number the bolt is disengaged and the lock opened.

The lock also comprises a mask 16 mounted on the plate 12 in such a manner that it can pivot in its plane around a pin 17 between a first position (FIG. 1) in which the wheels 14 are inaccessible and the figures present in the window 15 concealed, and a second position (FIG. 2) in which these digits are visible and the wheels 14 accessible, which makes it possible to turn them and thus to dial the combination number or effect a scrambling operation.

A return spring, not shown, automatically returns the mask 16 into its initial position when it is released. Under these conditions, the combination number is visible only during the very short period of time which elapses between the moment when said number is dialed and the moment when the mask, after having been held in its second position in order to carry out this operation, is released and resumes its initial position or, conversely, upon the closing. There is therefore very little danger of this number being seen and remembered by a third party.

Figure 3:
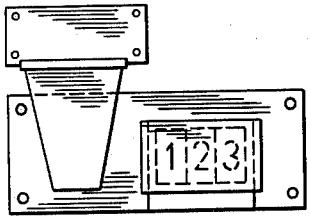
FIGS. 3 and 4 are views, similar to FIGS. 1 and 2, of a second embodiment.
Figure 4:
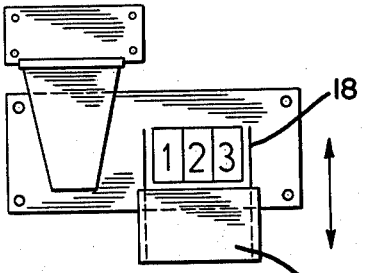

In the second embodiment (FIGS. 3 and 4) the mask 16 slides in a slideway 18 between the two positions shown against the action of a return spring, in the direction of movement during which the digits present in the window 16 are unmasked and with the assistance of this spring in the opposite direction.

Figure 5:
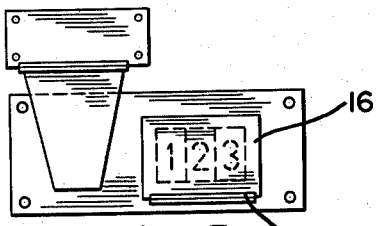
FIG. 5 is a view similar to FIG. 1 of a third embodiment.
Figure 6:
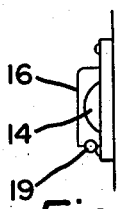
FIGS. 6 and 7 are side views, the mask being in its two respective positions.
Figure 7:
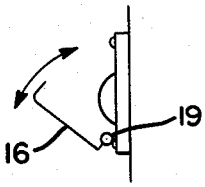

In the third embodiment shown (FIGS. 5, 6 and 7) the mask 16 pivots around a horizontal axis 19 between the two positions illustrated in FIGS. 6 and 7 again preferably with and against the action of a return spring respectively.

Figure 8:
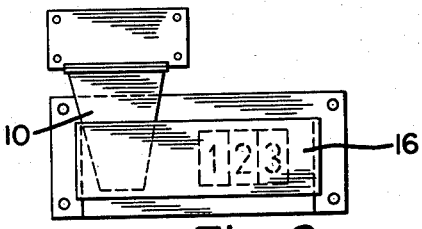
FIGS. 8 and 9 and 10 and 11 are views, similar to FIGS. 1 and 2, of two other embodiments.
Figure 9:
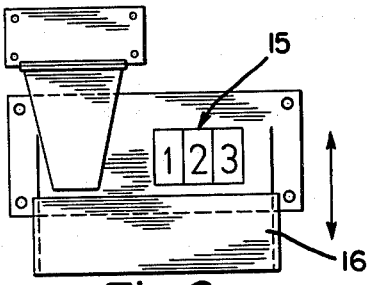

In the fourth embodiment (FIGS. 8 and 9) the mask 16 is similar to the mask of the third embodiment but it also covers in part the pivoting portion 10 of the clasp when it occupies the position in which the window 15 is covered.

In this case the mask 16 plays an additional role, namely as protection of the part 10 and as lock safety.

Figure 10:
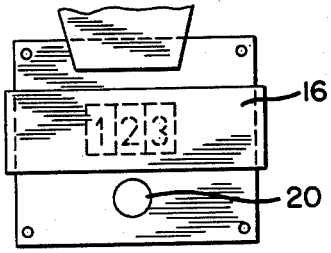
Figure 11:
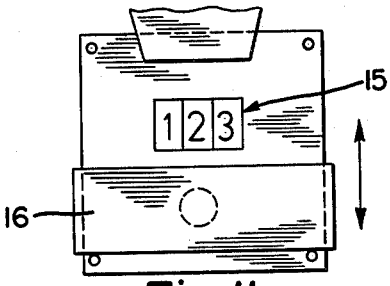

In the fifth embodiment (FIGS. 10 and 11) the lock has a push button 20 which is depressed when the combination number has been dialed so as to open it. The mask 16, which also slides as in the fourth embodiment, covers this button when the digits located in the window 15 are uncovered, and vice versa.

What is claimed is:

1. A combination lock for attache cases and the like comprising, a clasp having a movable clasp element, the lock having a plurality of movable elements having digits thereon for setting a combination for selectively locking the lock, said clasp element being in a locking position when the combination lock is locked, a mask biased to a first of two rest positions, said first position comprising a position in which the mask conceals the digits and blocks the movable element from moving to a position in which the clasp is open, and a second of said two positions comprising a position in which said mask exposes said digits to view and unmasks the clasp element.

2. A combination lock according to claim 1, in which said mask is pivoted for movement to said two positions, and means pivoting said mask.

3. A combination lock according to claim 1, in which said mask is slidable to said two positions, and means slidably mounting said mask.

4. A combination lock for attache cases and the like comprising, a plurality of movable elements having digits thereon for setting a combination for selectively locking the lock, a mask biased to a first of two rest positions, said first position comprising a position in which the mask conceals the digits, the second of said two positions comprising a position in which said mask exposes said digits to view, a button for opening the lock, and said button being disposed to underlie and be masked by said mask when its second position.

* * * * *